US006685517B2

(12) United States Patent
Matsuda et al.

(10) Patent No.: US 6,685,517 B2
(45) Date of Patent: Feb. 3, 2004

(54) PERSONAL WATERCRAFT

(75) Inventors: Yoshimoto Matsuda, Hyogo (JP); Yasuo Okada, Hyogo (JP); Hideaki Ebisui, Hyogo (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/225,922

(22) Filed: Aug. 22, 2002

(65) Prior Publication Data

US 2003/0040231 A1 Feb. 27, 2003

(30) Foreign Application Priority Data

Aug. 24, 2001 (JP) ..... 2001-254020

(51) Int. Cl.[7] ..... B63H 11/02

(52) U.S. Cl. ..... 440/39; 440/88 C; 440/88 E; 440/88 J; 440/88 N

(58) Field of Search ..... 440/88 C, 88 D, 440/88 G, 88 F, 88 N, 39

(56) References Cited

U.S. PATENT DOCUMENTS 4,133,284 A * 1/1979 Holcroft ..... 440/88 R
4,239,013 A * 12/1980 Haynes ..... 440/40
5,746,054 A * 5/1998 Matte ..... 60/310
5,813,888 A * 9/1998 Ozawa ..... 440/88 N
2002/0182949 A1 * 12/2002 Tanaka et al. ..... 440/88
2003/0005689 A1 * 1/2003 Matsuda et al. ..... 60/321
2003/0027466 A1 * 2/2003 Matsuda et al. ..... 440/38

* cited by examiner

*Primary Examiner*—Sherman Basinger
(74) *Attorney, Agent, or Firm*—Marshall, Gerstein & Borun LLP

(57) ABSTRACT

Disclosed is a personal watercraft having a water cooling system of an engine, which allows inside of a cooling water passage of an engine or a water passage connected to the cooling water passage to be sufficiently cleaned and a clogged water-supply hole in an expansion chamber to be easily inspected or cleaned. The personal watercraft 1 comprises a first water passage 50 from a water jet pump 7 to a cooling water passage of an engine 4. Water is forcibly sent by the water jet pump 7 and led to the cooling water passage through the first water passage 50. The water flows through the cooling water passage while exchanging heat, and the resulting water is discharged outside the watercraft. The personal watercraft 1 further comprises a second water passage 53 opened in a surface of a body of the watercraft and communicating with the first water passage 50, and an opening/closing means 54 for opening/closing the second water passage 53.

9 Claims, 6 Drawing Sheets

PRIOR ART

PERSONAL WATERCRAFT

BACKGROUND OF THE INVENTION

1. Field of the Invention

The present invention relates to a personal watercraft (PWC) which ejects water rearward and planes on a water surface as the resulting reaction, and more particularly to a personal watercraft having a water cooling system of an engine.

2. Description of the Related Art

In recent years, personal watercraft have been widely used in leisure, sport, rescue activities, and the like. The personal watercraft has a straddle-type body structure, and is configured to have a water jet pump that pressurizes and accelerates water sucked from a water intake generally provided on a hull bottom surface and ejects it rearward from an outlet port. Thereby, the personal watercraft is propelled.

In general, the personal watercraft employs an engine cooling system in which its engine is cooled by the water from the water jet pump and thereafter, the water is discharged outside the watercraft, rather than a closed circulation type engine cooling system of automobile.

FIG. 6 is a schematic structure of the engine cooling system of the personal watercraft. In the engine cooling system, a water jet pump 107 is connected to an engine 104 through a pipe 150. A cooling water passage (water jacket) is formed in the engine 104. A filter 151 is provided in the pipe 150. The filter 151 serves to eliminate substances such as small stones and waterborne plants.

In the personal watercraft using this cooling system, a riding seat is openable/closable or otherwise removable. By opening or removing the riding seat, an opening formed in a deck is exposed. In maintenance and replacement of the filter 151, the filter 151 is accessible through the opening.

The cooling water passage formed in the engine 104 will now be described. The engine 104 is comprised of an engine body portion 120, an exhaust system 130. The engine body portion 120 is constituted by a cylinder block, a cylinder head, a crankcase, a crankshaft, pistons, and the like. The exhaust system 130 is constituted by an exhaust manifold, an exhaust pipe, an expansion chamber, a water muffler, an exhaust duct, and the like.

A water passage is formed in the cylinder block and the cylinder head. A water passage is also formed in the exhaust manifold, the exhaust pipe, and the expansion chamber. The cooling water passage of the engine 104 is comprised of these water passages.

The water is pumped into the pipe 150 by the water jet pump 107. The water flows through the filter 151 provided in the pipe 150 and then into the water passage of the exhaust system 130. Part of the water flowing into the water passage of the exhaust system 130 is diverged to flow and circulate through the water passage of the engine body portion 120 and is returned again to the water passage of the exhaust system 130.

An outlet of the cooling water passage of the engine 104 is connected to a pipe 156. A tip end of the pipe 156 extends to a pump room in the water jet pump 107. In brief, the water is sent into the cooling water passage of the engine by the water jet pump 107 and flows through the cooling water passage while exchanging heat, and the resulting water is sent into the pump room in the water jet pump 107 and discharged outside the watercraft.

A water-supply hole is provided in the expansion chamber. The cooling water is supplied to the inside of the expansion chamber through the water-supply hole and then sent into the water muffler, together with an exhaust gas.

In maintenance of the engine or the like of the personal watercraft, the personal watercraft is landed and the water in the cooling water passage of the engine is discharged.

However, in the personal watercraft having the water cooling system shown in FIG. 6, all the water in the cooling water passage of the engine 104 or the pipes 150, 156 is not discharged and is sometimes partially left. Even when all the water is discharged, the substances such as small stones or waterborne plants sometimes still remain in the cooling water passage or the pipes 150, 156. Further, especially after cruising on sea, salt remains adhered to the inner peripheral walls of the cooling water passage of the engine 104 or the pipes 150, 156.

As described above, the filter 151 is provided on the pipe 150 for eliminating the substances. For ease of maintenance of the filter 151, it is preferable that a portion of the pipe 150 where the filter 151 is provided is lifted relatively higher so that the filter 151 is readily accessible through the opening exposed by opening or removing the riding seat. Nonetheless, when the pipe 150 is partially higher than an inlet of the cooling water passage of the engine 104, the water between the higher portion and the inlet of the cooling water passage is difficult to discharge. The ease of discharge of the water is incompatible with the ease of maintenance of the filter 151. This limits layout of the pipe 150.

When the water-supply hole of the expansion chamber is clogged, the exhaust system 130 needs to be disassembled for cleaning the water-supply hole.

SUMMARY OF THE INVENTION

The present invention addresses the above-described condition, and an object of the present invention is to provide a personal watercraft having a water cooling system of an engine, which allows inside of a cooling water passage of an engine or a water passage connected to the cooling water passage of the engine to be sufficiently cleaned.

Another object of the present invention is to provide a personal watercraft that allows a water-supply hole of an expansion chamber to be easily inspected and cleaned.

According to the present invention, there is provided a personal watercraft comprising: a water jet pump; a cooling water passage of an engine; a first water passage from the water jet pump to the cooling water passage; a second water passage opened in a surface of a body of the watercraft and communicating with the first water passage; and an opening/closing means for opening/closing the second water passage, wherein a cooling water is forcibly sent to the first water passage by the water jet pump and led to the cooling water passage through the first water passage, the water flows through the cooling water passage while exchanging heat, and the resulting water is discharged outside the body of the watercraft.

In the personal watercraft so constituted, after the personal watercraft is landed, water in the cooling water passage is discharged from the second water passage by opening the second water passage. Further, a cleaning water can be forcibly supplied from the outside into the cooling water passage and the first water passage through the second water passage. Thus, the inside of the cooling water passage of the engine and the first water passage can be positively cleaned even in the case of using the water passage of ups and downs. Consequently, degree of freedom of layout of the first water passage is improved.

A first portion of the first water passage may be located higher than an inlet of the cooling water passage, and the second water passage may branch from a position of the first water passage between the first portion and the inlet of the cooling water passage.

When the first portion of the first passage is located higher than the inlet of the cooling water passage, the water in the first water passage between the first portion and the inlet of the cooling water passage is hardly discharged merely by landing the personal watercraft. However, in the above-mentioned structure, such water can be easily discharged from the second water passage. Further, by forcibly flowing the cleaning water into the first water passage through the second water passage, the cooling water between the first portion and inlet of the cooling water passage can be expelled.

In the personal watercraft, a filter may be provided in the first water passage, and the second water passage may branch from a position of the first water passage between the filter and an inlet of the cooling water passage.

When the filter is provided on the first water passage, the water in the first water passage between the filter and the inlet of the cooling water passage is hardly discharged merely by landing the personal watercraft. This is because the water between the filter and the inlet is less likely to flow back through the filter, and therefore is difficult to discharge. However, in the above-mentioned structure, such water is easily discharged through the second water passage. Besides, by forcibly flowing the cleaning water into the first water passage through the second water passage, the water between the filter and the inlet of the cooling water passage can be expelled.

A tip end of the second water passage may be opened in a rear end face of the body.

According to the present invention, there is further provided a personal watercraft comprising: an expansion chamber in an exhaust system of an engine; and a water muffler provided at a position downstream of the expansion chamber in the exhaust system of the engine, wherein the expansion chamber has a double-walled structure comprised of inner and outer walls between which water flows and is provided with a water-supply hole in the inner wall to allow water to be supplied into inside of the expansion chamber through the water-supply hole, an inspection hole is formed in the outer wall at a position corresponding to a position of the water-supply hole, and a cap member is removably attached to the inspection hole.

Since the inspection hole is formed in the outer wall of the double-walled structure of the expansion chamber at the position corresponding to the water-supply hole, the water-supply hole is readily accessible through the inspection hole by removing the cap member. Therefore, the inspection of the water-supply hole can be easily carried out and the water-supply hole can be easily cleaned.

The exhaust system may be provided with a temperature sensor located downstream of the water-supply hole in an exhaust gas flow path, for detecting temperature of an exhaust gas.

In the above-mentioned structure, the clogging in the water-supply hole can be quickly found by detecting that the temperature of the exhaust gas is higher than a proper temperature.

The above and further objects and features of the invention will be more fully be apparent from the following detailed description with accompanying drawings.

DETAILED DESCRIPTION OF THE PREFERRED EMBODIMENTS

Hereinafter, an embodiment of the present invention will be described in detail with reference to the accompanying drawings.

Figure 1:
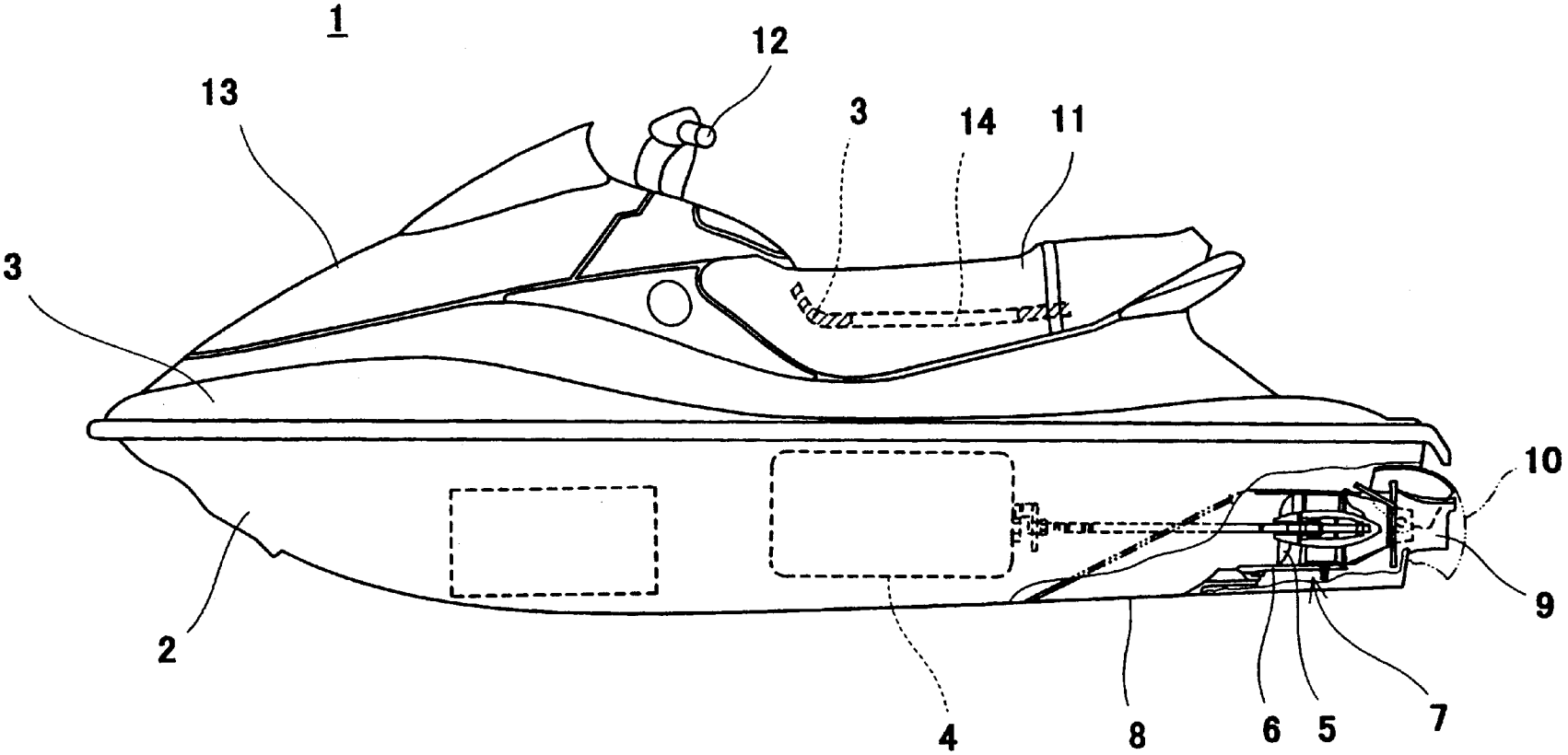
FIG. 1 is a side view of a personal watercraft according to an embodiment of the present invention.

FIG. 1 is a side view of a personal watercraft 1 according to an embodiment of the present invention.

The personal watercraft 1 has a FRP body. The body is mainly comprised of a hull 2 and a deck 3 covering the hull 2 from above. An engine (internal combustion engine) 4 as a power source is equipped inside of the body comprised of the hull 2 and the deck 3. The rotation of the engine 4 is transmitted to an impeller 5 through a drive shaft. The impeller 5 and a casing 6 enclosing the outer periphery of the impeller 5 constitute a water jet pump 7.

An opening is provided as a water intake 8 in a bottom surface of the hull 2. The water is sucked from the water intake 8 and fed to the water jet pump 7. The water jet pump 7 pressurizes and accelerates the water. The pressurized and accelerated water is discharged through a pump nozzle behind the water jet pump 7, thereby propelling the personal watercraft 1. The pump nozzle is covered with a steering nozzle 9 provided behind the pump nozzle. In FIG. 1, reference numeral 10 denotes a reverse deflector. The deflector 10 is swung downward to a lower position around a horizontally mounted swinging shaft to deflect the ejected water from the steering nozzle 9 forward, and as the resulting reaction, the personal watercraft 1 moves rearward.

A straddle-type riding seat 11 is mounted at the center portion of the deck 3. A steering handle 12 is provided in front of the seat 11. When the rider steers the steering handle 12 clockwise or counterclockwise, the steering nozzle 9 is swung toward the opposite direction so that the watercraft 1 can be correspondingly turned to a desired direction. A hatch cover 13 is mounted in front of the handle 12 so as to partially cover the deck 3.

The seat 11 is openable/closable or removable from the deck 3. When the rider is driving the watercraft 1, the seat 11 is mounted on the deck 3. During maintenance of the engine 4 or the like inside of the body, the seat 11 is opened/removed from the deck 3. By opening/removing the seat 11, an opening 14 formed in the deck 3 is exposed, and maintenance operations or the like of equipment such as an engine inside of the deck 3 and the hull 2 can be carried out through the opening 14.

Figure 2:
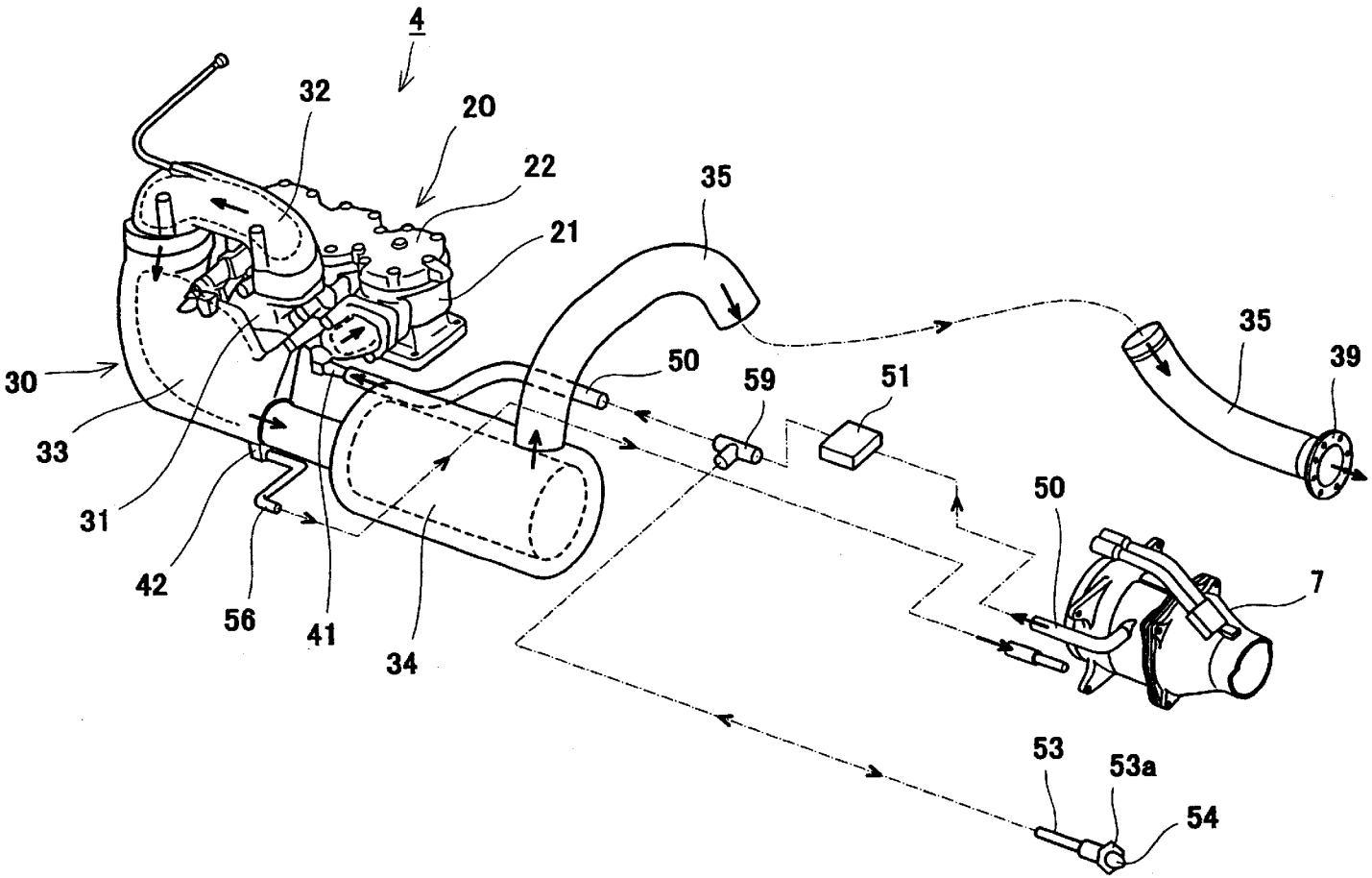
FIG. 2 is a perspective view showing a cooling system of an engine of the personal watercraft in FIG. 1.
Figure 3:
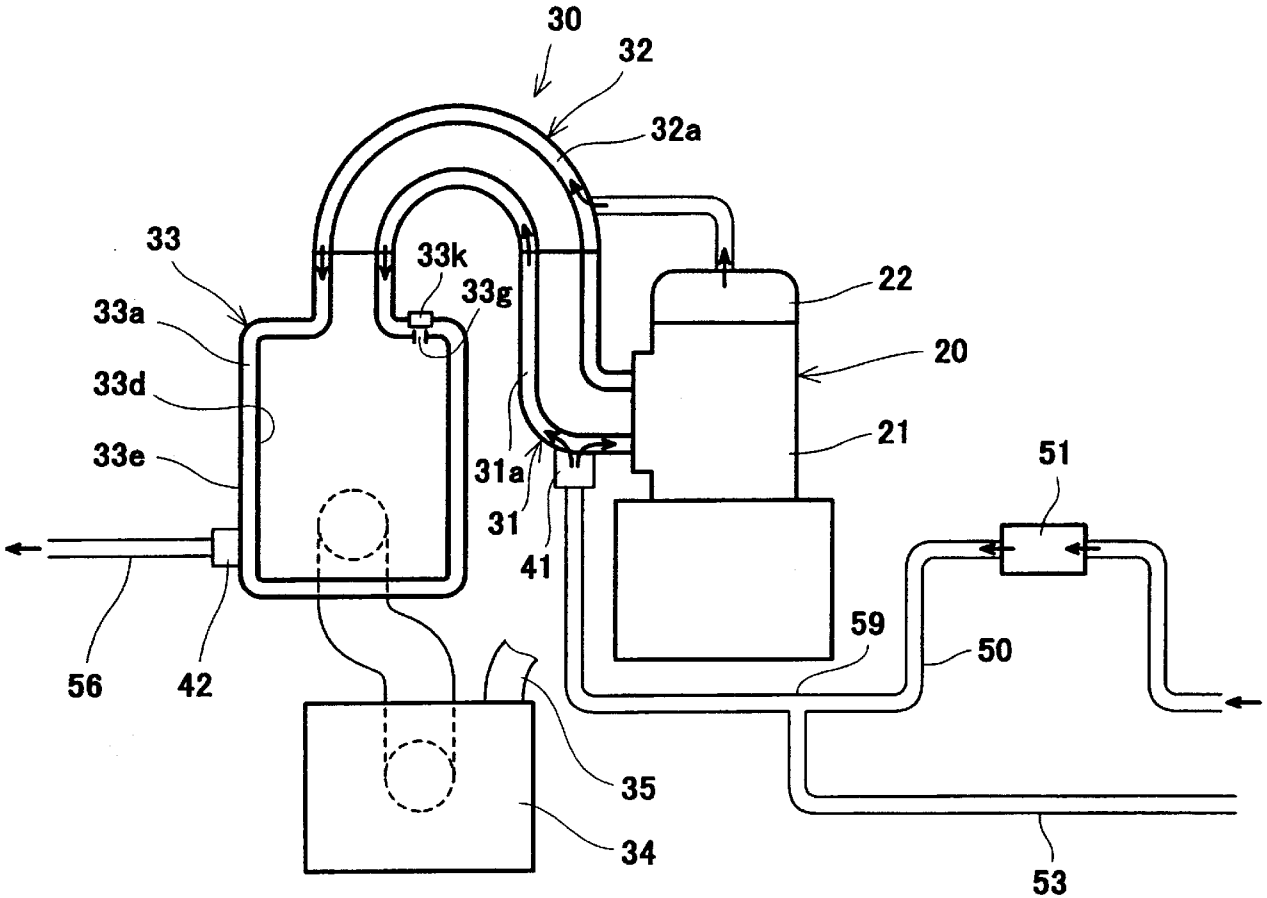
FIG. 3 is a schematic view showing a structure of cooling water passages in an engine body portion and an exhaust system and water passages connected to the cooling water passages.

FIG. 2 is a view showing a cooling system of the engine 4 of the personal watercraft 1. FIG. 3 is a schematic view showing a structure of cooling water passages in an engine body portion 20 and an exhaust system 30 and water passages connected to the cooling water passages. In FIG. 2, portions other than connected portions of the pipes 50, 53, 56 are not illustrated. In FIG. 3, arrows show a direction of flow of cooling water.

In the personal watercraft 1, the water pumped by the water jet pump 7 is used for cooling the engine 4.

The engine 4 is comprised of the engine body portion 20, the exhaust system 30, and the like. The exhaust gas generated in the engine body portion 20 is discharged from an exhaust outlet 39 formed in a rear end face of the body of the watercraft through the exhaust system 30.

The engine body portion 20 is constituted by a cylinder block 21, a cylinder head 22, a crankcase (not shown), a crankshaft (not shown), pistons (not shown), and the like. In FIG. 2, only the cylinder block 21 and the cylinder head 22 are illustrated. The exhaust system 30 is constituted by an exhaust manifold 31, an exhaust pipe 32, an expansion chamber 33, a water muffler 34, an exhaust duct 35, and the like.

A water passage is formed in the cylinder block 21 and the cylinder head 22. A water passage is also formed in the exhaust manifold 31, the exhaust pipe 32, and the expansion chamber 33. The cooling water passage of the engine 4 is comprised of the water passage of the engine body portion 20 and the water passage of the exhaust system 30 and constituted as a water jacket.

The water passage of the exhaust system 30 is formed by a double-walled structure of the exhaust manifold 31, the exhaust pipe 32, and the expansion chamber 33. To be specific, the exhaust manifold 31, the exhaust pipe 32, and the expansion chamber 33 in the exhaust system 30 have at least partially double-walled structure comprised of inner and outer walls between which the cooling water flows.

The water passage of the cylinder block 21 communicates with the water passage of the cylinder head 22. The water passage 31*a* of the exhaust manifold 31 communicates with the water passage 32*a* of the exhaust pipe 32, which communicates with a water passage 33*a* of the expansion chamber 33. Further, the water passage 31*a* of the exhaust manifold 31 communicates with the water passage of the cylinder block 21, and the water passage of the cylinder head 22 communicates with the water passage 32*a* of the exhaust pipe 32.

A water-supply hole 33*g* for discharging the cooling water in the exhaust gas flowing in the expansion chamber is formed in an inner wall 33*d* of the expansion chamber 33. A water muffler 34 is mounted downstream of the expansion chamber 33 in an exhaust gas flow path.

The water jet pump 7 is connected to the exhaust manifold 31 through the pipe 50. To be specific, a base end of the pipe 50 is connected to the water jet pump 7 and a tip end of the pipe 50 is connected to a cooling water passage inlet 41 formed in the exhaust manifold 31. The pipe 50 functions as the water passage connecting the water-jet pump 7 to the cooling water passage inlet 41.

A filter 51 is provided at an intermediate position of the pipe 50, for eliminating substances such as small stones and waterborne plants. The filter 51 is located beneath the riding seat 11. The pipe 50 is curved, for example, substantially inverted-U shaped at a mid portion of the pipe 50 so as to be highest at the position where the filter 51 is provided. The filter 51 is located in the vicinity of the opening 14 so that the filter 51 is readily accessible through the opening 14 exposed when the riding seat 11 is opened or removed from the deck 3. Consequently, maintenance and replacement of the filter 51 are easily carried out.

Since the pipe 50 is protruded upward so as to be highest at the filter 51, the filter 51 is located higher than the cooling water passage inlet 41 formed in the exhaust manifold 31 (see FIG. 2).

The expansion chamber 33 is connected to the water jet pump 7 through a pipe 56 in such a manner that a base end of the pipe 56 is connected to a cooling water passage outlet 42 formed in the expansion chamber 33 and a tip end of the pipe 56 extends to a pump room in the water jet pump 7. As defined herein, the pump room refers to an inner space of the casing 6 constituting the water jet pump 7. The tip end of the pipe 56 is attached to the water jet pump 7 at a position downstream of the base end of the pipe 50 in the water jet pump 7. The tip end of the pipe 56 is located so that the water in the pipe 56 is suctioned into the pump room by a negative pressure of the water accelerated by the water jet pump 7.

Figure 4:
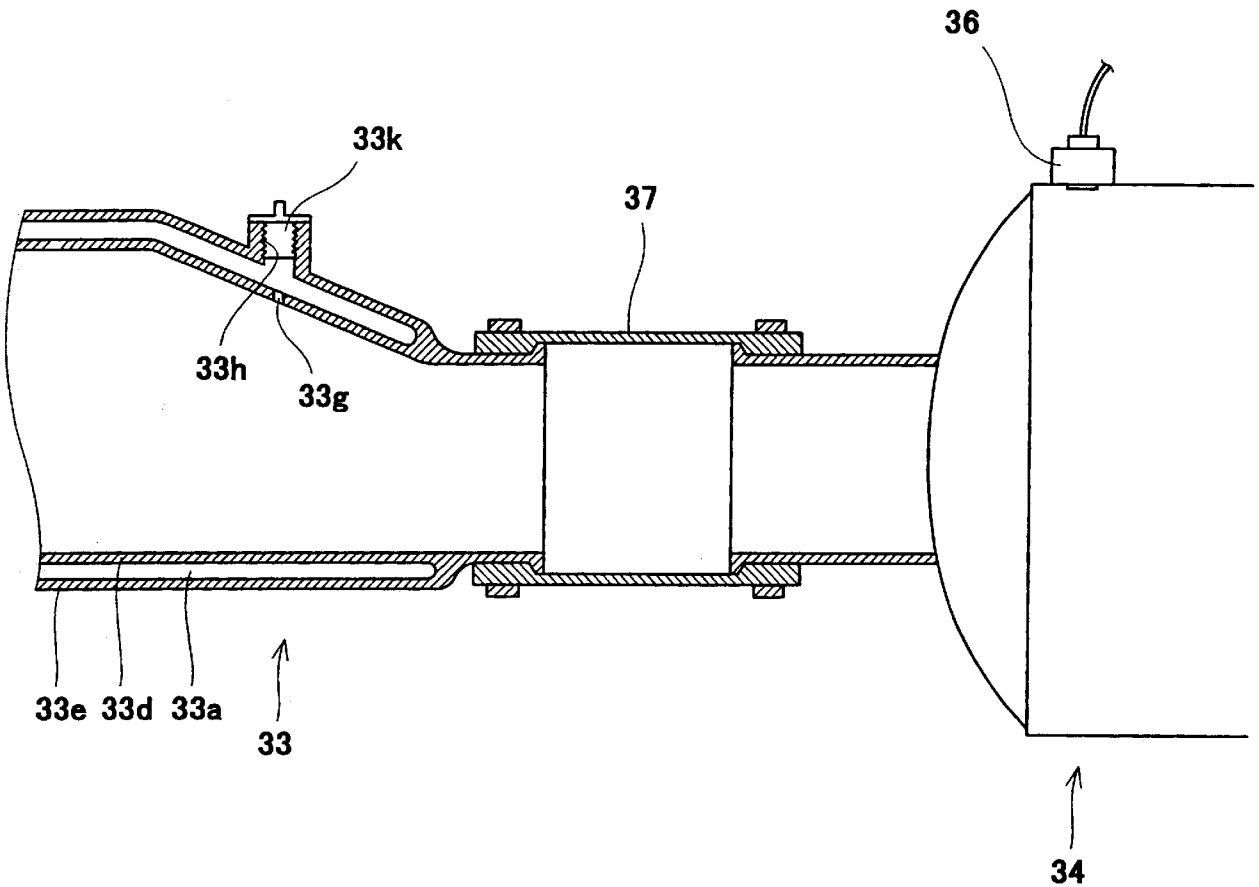
FIG. 4 is a longitudinal sectional view showing a portion where an expansion chamber is connected to a water muffler.

FIG. 4 is a longitudinal sectional view of the portion where the expansion chamber 33 is connected to the water muffler 34. The expansion chamber 33 is connected to the water muffler 34 through a flexible connecting pipe 37 such as a rubber pipe. The water-supply hole 33*g* is formed in the inner wall 33*d* of the expansion chamber 33 in the vicinity of the connecting pipe 37. An inspection hole 33*h* is formed in an outer wall 33*e* of the expansion chamber 33 at a position above the water-supply hole 33*g*. Preferably, the inspection hole 33*h* is designed to be concentric with the water-supply hole 33*g*. This facilitates drilling work. To be specific, a pilot hole for the inspection hole 33*h* and the water-supply hole 33*g* can be formed simultaneously or in a series of work.

The inspection hole 33*h* is closed by a plug 33*k* as a cap member. A female screw is provided on the inspection hole 33*h* and a male screw is provided on the plug 33*k*. These screws are threadedly engaged. That is, the plug 33*k* is removably attached to the inspection hole 33*h*.

A temperature sensor 36 is attached on the water muffler 34 located downstream of the water-supply hole 33*g* in the exhaust gas flow path in the exhaust system 30. The temperature sensor 36 is adapted to detect the temperature of the exhaust gas flowing through the inside of the water muffler 34.

Referring to FIGS. 2, 3 again, the pipe 53 branches from the pipe 50. That is, the base end of the pipe 53 is connected at an intermediate position of the pipe 50, i.e., a branch point 59. The branch point 59 is located between the filter 51 and the cooling water passage inlet 41. The pipe 53 extends substantially horizontally toward the rear of the personal watercraft 1 without ups and downs such that its tip end extends to a rear end face 15 (see FIG. 5) of the personal watercraft 1 so as to open in a surface of the body of the watercraft. The pipe 53 functions as the water passage through which the water passage comprised of the pipe 50 communicates with an outside of the body.

Figure 5:
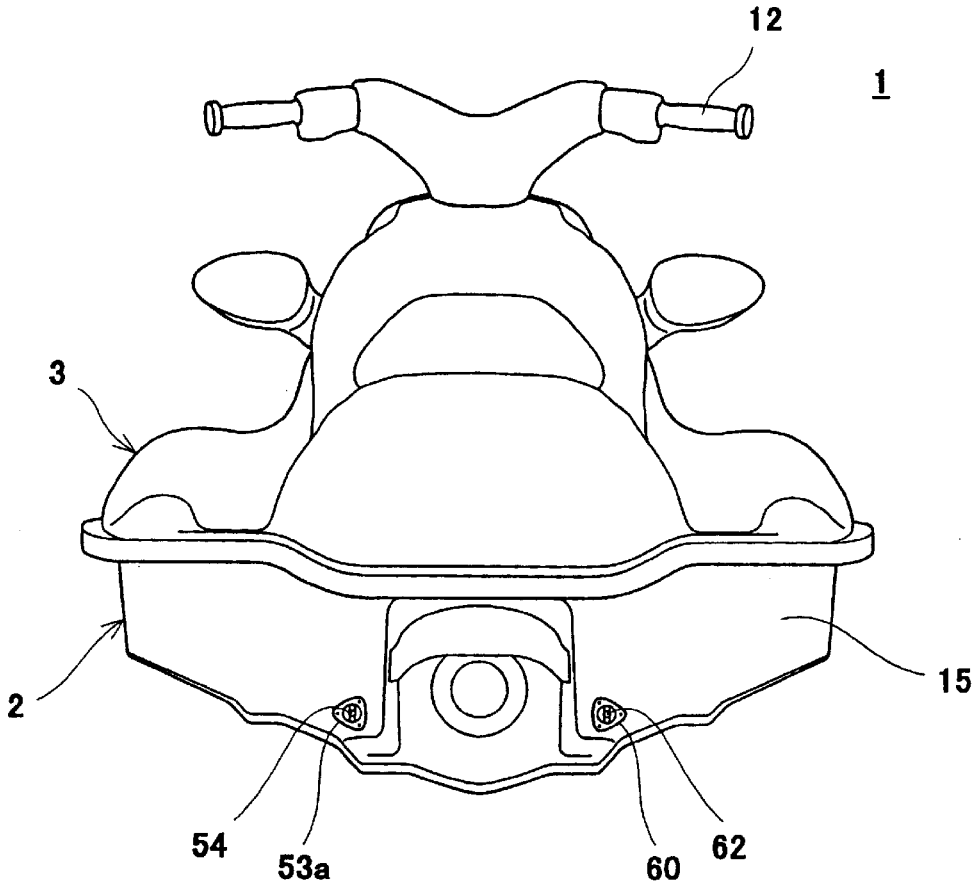
FIG. 5 is a rear view showing the personal watercraft in FIG. 1.
Figure 6:
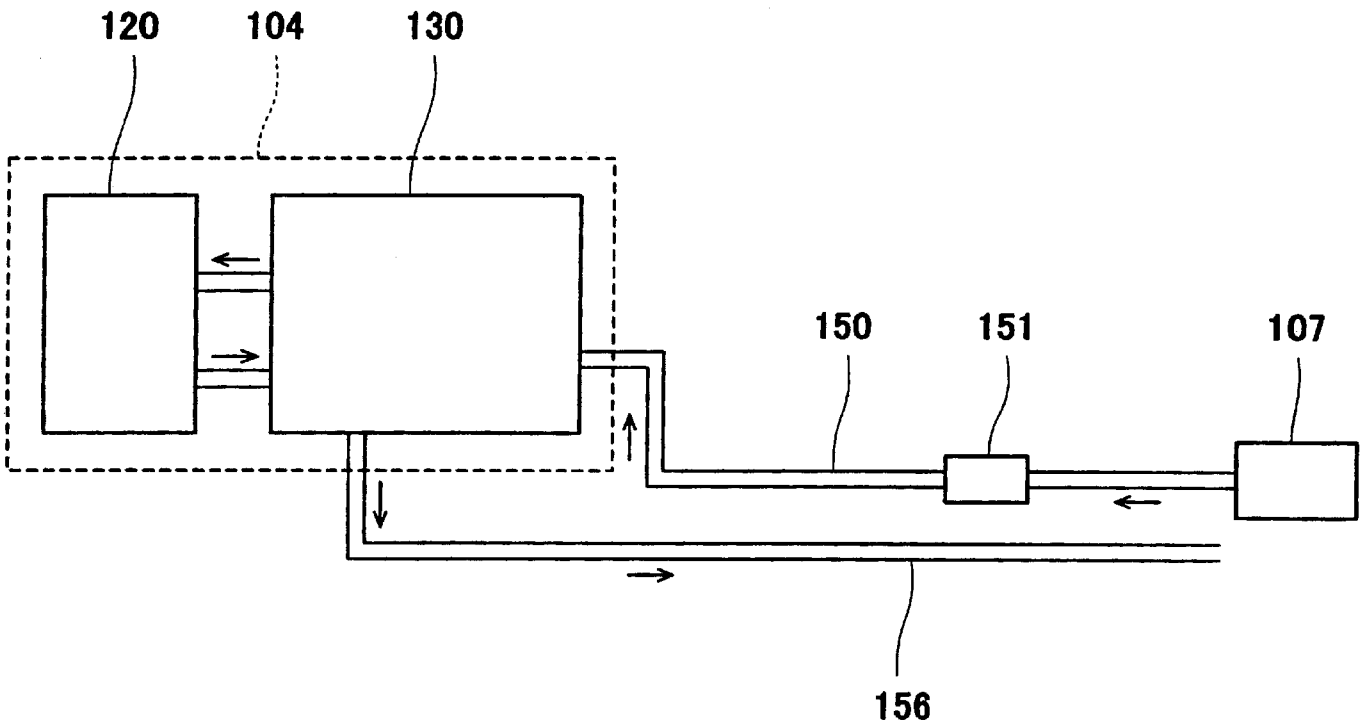
FIG. 6 is a schematic view showing a cooling system of an engine of the conventional personal watercraft.

FIG. 5 is a rear view of the personal watercraft 1. As shown in FIG. 5, an opening 53*a* at the tip end of the pipe 53 is located in the rear end face 15 of the watercraft 1. The opening 53*a* is closed by a removable plug 54. The water passage comprised of the pipe 53 is opened/closed by removing/attaching the plug 54.

The opening 53*a* and an opening 60 are provided lateral symmetrically in the rear end face 15. The opening 60 is a discharge port through which the water inside of the body is discharged and is closed by a removable plug 62.

The personal watercraft 1 constituted as described above is driven with the opening 53*a* closed by the plug 54.

During driving of the personal watercraft 1, the exhaust gas in the engine 4 flows through the exhaust manifold 31, the exhaust pipe 32, the expansion chamber 33, the water muffler 34, and the exhaust duct 35 and is discharged outside through the exhaust outlet 39.

The water is pumped into the pipe 50 by the water jet pump 7. The water flows through the filter 51 provided on the pipe 50 and into the water passage 31*a* of the exhaust manifold 31 through the cooling water passage inlet 41.

The water flowing into the water passage 31*a* of the exhaust manifold 31 is divided so as to flow through the water passage of the cylinder block 21 and further into the water passage of the cylinder head 22. The water that has finished heat exchange with the engine body portion 20 flows into the water passage 32*a* of the exhaust pipe 32. The remaining water flowing through the water passage 31*a* also flows directly into the water passage 32*a* of the exhaust pipe 32.

The water in the water passage 32*a* of the exhaust pipe 32 flows into the water passage 33*a* of the expansion chamber 33. The water that has finished heat exchange with the exhaust system 30 flows into the pipe 56 through the cooling water passage outlet 42. The water is discharged into the pump room of the water jet pump 7 through the pipe 56 and then outside the watercraft.

Part of the water flowing through the water passage 33*a* of the expansion chamber 33 is supplied to the inside of the expansion chamber 33 through the water-supply hole 33*g*. The water flows into the water muffler 34 along with the exhaust gas, and further through the exhaust duct 35, to be discharged from the exhaust outlet 39 formed in a stem of the watercraft 1 to the outside of the watercraft 1.

After cruising of the personal watercraft 1, the watercraft 1 is landed for maintenance of the engine 4 and the like. For example, the water is discharged from the cooling water passage of the engine 4.

While the personal watercraft 1 is landed, part of the water in the cooling water passage of the engine 4 and the pipe 56 is discharged into the pump room through the opening at the tip end of the pipe 56. Simultaneously, part of the water in the pipe 50 is discharged into the water jet pump 7 through the opening at the base end of the pipe 50.

Even after part of the water is thus discharged from the cooling water passage of the engine 4 and the pipes 50, 56, the substances contained in the water sometimes still remain. In the case of sea water, salt is adhered to the inner peripheral walls of the cooling water passage of the engine 4 or the pipes 50, 56.

All of the water in the cooling water passage of the engine 4 and the pipes 50, 56 is not discharged while the personal watercraft 1 is landed. Especially, since the portion of the pipe 50 where the filter 51 is provided is higher than the cooling water passage inlet 41, the water remaining in the portion of the pipe 50 between the filter 51 and the cooling water passage inlet 41 is very difficult to discharge.

For the purpose of full discharge of the water in the cooling water passage of the engine 4 and the pipes 50, 56, the plug 54 attached to the opening 53*a* in the rear end face 15 of the personal watercraft 1 is removed. Thereby, part of the water remaining in the portion of the pipe 50 between the filter 51 and the cooling water passage inlet 41 flows through the pipe 53 and is discharged through the opening 53*a*.

After that, fresh water is forcibly sent as cleaning water from the opening 53*a*. To this end, for example, the tip of a rubber hose connected to a water pipe is inserted into the opening 53*a*, in which state the water is supplied from the water pipe into the pipe 53. The cleaning water is divided at the branch point 59 so as to flow toward the tip end of the pipe 50 and toward the base end of the pipe 50. The cleaning water flowing toward the base end of the pipe 50 serves to clean the filter 51 by a counter flow. The cleaning water flowing toward the tip end of the pipe 50 flows through the water passages through which the cooling water flows during driving of the personal watercraft 1, and finally, is discharged into the pump room of the water jet pump 7. As a result, the inside of the cooling water passage of the engine 4 and the pipes 50, 56 is cleaned by the cleaning water. At this time, the sea water remaining in the cooling water passage of the engine 4 and the pipes 50,56, the substances such as small stones or waterborne plants, or salt adhered to the inner peripheral walls of the cooling water passage and the pipes 50, 56 are discharged. In this manner, the inside of the pipes 50, 56 is positively cleaned. Consequently, the degree of freedom of layout of the pipes 50, 56 is improved. For example, the curved pipe 50 of this embodiment may be used.

The cleaning water sometimes remains in the cooling water passage of the engine 4 or the pipes 50, 56 after the water is stopped. It should be appreciated that, the cleaning water hardly damages the engine body portion 20 or the exhaust system 30 because the cleaning water is the fresh water free from substances.

As described above, the opening 53*a* and the opening 60 are provided lateral symmetrically in the rear end face 15. Since the opening 60 is the discharge port through which the water inside of the body of the watercraft is discharged, the plug 62 is removed from the opening 60 after the personal watercraft 1 is landed. Since the opening 53*a* and the opening 60 are provided lateral symmetrically in the rear end face 15, the plug 54 is noticed by the user when the plug 62 is removed. This advantageously prevents the user from forgetting to discharge or clean the cooling water passage of the engine 4.

During driving of the personal watercraft 1, if the temperature sensor 36 attached to the water muffler 34 detects that the temperature of the exhaust gas in the water muffler 34 is higher than a proper temperature, this shows that the water-supply hole 33*g* of the expansion chamber 33 might be clogged with substances. In that case, the personal watercraft 1 is first landed and then the plug 33*k* of the expansion chamber 33 is removed for the purpose of inspection of the water-supply hole 33*g*. When it is detected that the water-supply hole 33*g* is clogged, the clogged water-supply hole 33*g* is cleaned. Thus, the inspection and maintenance of the water-supply hole 33*g* are easily carried out.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft comprising:

a water jet pump;

a cooling water passage of an engine;

a first water passage from the water jet pump to the cooling water passage, said first water passage having a first portion located higher than an inlet of the cooling water passage a second water passage opened in a surface of a body of the watercraft and communicating with the first water passage, said second water passage branching from a position of the first water passage between the first portion and the inlet of the cooling water passage; and an opening/closing means for opening/closing the second water passage, wherein a cooling water is forcibly sent by the water jet pump and led to the cooling water passage through the first water passage, the water flows through the cooling water passage while exchanging heat, and the resulting water is discharged outside the body of the watercraft.

2. A personal watercraft comprising:

a water jet pump;

a cooling water passage of an engine;

a first water passage from the water jet pump to the cooling water passage, wherein a filter for the cooling water is provided in the first water passage;

a second water passage opened in a surface of a body of the watercraft and communicating with the first water passage, the second water passage branching from a position of the first water passage between the filter and an inlet of the cooling water passage; and an opening/closing means for opening/closing the second water passage ,wherein a cooling water is forcibly sent by the water jet pump and led to the cooling water passage through the first water passage, and the water flows through the cooling water passage while exchanging heat, and the resulting water is discharged outside the body of the watercraft.

3. The personal watercraft according to claim 1, wherein a tip end of the second water passage is opened in a rear end face of the body.

4. A personal watercraft comprising:

a water jet pump;

a cooling water passage of an engine;

a first water passage from the water jet pump to the cooling water passage;

a second water passage opened in a surface of a body of the watercraft and communicating with the first water passage; and an opening/closing means for opening/closing the second water passage, wherein a cooling water is forcibly sent by the water jet pump and led to the cooling water passage through the first water passage, the water flows through the cooling water passage while exchanging heat, and the resulting water is discharged outside the body of the watercraft, said personal watercraft further comprising:

an expansion chamber in an exhaust system of an engine; and a water muffler provided at a position downstream of the expansion chamber in the exhaust system of the engine, wherein the expansion chamber has a double-walled structure comprised of inner and outer walls between which water flows and is provided with a water-supply hole in the inner wall to allow water to be supplied into inside of the expansion chamber through the water-supply hole, an inspection hole is formed in the outer wall at a position corresponding to a position of the water-supply hole, and a cap member is removably attached to the inspection hole.

5. The personal watercraft according to claim 4, wherein the exhaust system is provided with a temperature sensor located downstream of the water-supply hole in an exhaust gas flow path, for detecting temperature of an exhaust gas.

6. The personal watercraft according to claim 5, wherein the temperature sensor is provided on the water muffler.

7. A personal watercraft comprising:

an expansion chamber in an exhaust system of an engine; and a water muffler provided at a position downstream of the expansion chamber in the exhaust system of the engine, wherein the expansion chamber has a double-walled structure comprised of inner and outer walls between which water flows and is provided with a water-supply hole in the inner wall to allow water to be supplied into inside of the expansion chamber through the water-supply hole, an inspection hole is formed in the outer wall at a position corresponding to a position of the water-supply hole, and a cap member is removably attached to the inspection hole.

8. The personal watercraft according to claim 7, wherein the exhaust system is provided with a temperature sensor located downstream of the water-supply hole in an exhaust gas flow path, for detecting temperature of an exhaust gas.

9. The personal watercraft according to claim 8, wherein the temperature sensor is provided on the water muffler.

* * * * *

UNITED STATES PATENT AND TRADEMARK OFFICE

CERTIFICATE OF CORRECTION

PATENT NO. : 6,685,517 B2
DATED : February 3, 2004
INVENTOR(S) : Matsuda et al.

It is certified that error appears in the above-identified patent and that said Letters Patent is hereby corrected as shown below:

Title page,
Item [73], Assignee, please delete “Kobe” and insert -- Hyogo -- in its place.

Signed and Sealed this

Eleventh Day of May, 2004

JON W. DUDAS
*Acting Director of the United States Patent and Trademark Office*